US006896142B2

(12) United States Patent
Kaltz, Jr. et al.

(10) Patent No.: US 6,896,142 B2
(45) Date of Patent: May 24, 2005

(54) DUNNAGE

(75) Inventors: Thomas Richard Kaltz, Jr., Warren, MI (US); Donna Lou Lucas, River Rouge, MI (US)

(73) Assignee: Carroll Packaging, Dearborn, MI (US)

( * ) Notice: Subject to any disclaimer, the term of this patent is extended or adjusted under 35 U.S.C. 154(b) by 0 days.

(21) Appl. No.: 10/619,666

(22) Filed: Jul. 15, 2003

(65) Prior Publication Data

US 2005/0011799 A1 Jan. 20, 2005

(51) Int. Cl.[7] ..... B65D 81/02; B65D 81/05; B65D 85/30

(52) U.S. Cl. ..... 206/585; 206/521; 206/593

(58) Field of Search ..... 206/335, 521, 206/593, 590, 594, 587, 585, 588, 589; 211/153; 312/107, 128

(56) References Cited

U.S. PATENT DOCUMENTS

| | | | | |
|---|---|---|---|---|
| 2,539,372 A | | 1/1951 | Metzler | |
| 2,844,268 A | | 7/1958 | Lambert | |
| 2,879,886 A | | 3/1959 | Crane | |
| 3,043,488 A | | 7/1962 | Warwick | |
| 3,185,307 A | * | 5/1965 | Higgins | 211/40 |
| 3,259,003 A | | 7/1966 | Griffin | |
| 3,311,232 A | | 3/1967 | Howell | |
| 3,344,916 A | | 10/1967 | Brueckner | |
| 3,714,310 A | | 1/1973 | Gaffney, et al. | |
| 3,771,646 A | | 11/1973 | Mascetti, Jr. | |
| 3,790,652 A | | 2/1974 | Colijn et al. | |
| 3,872,194 A | | 3/1975 | Lowry et al. | |
| 3,924,738 A | | 12/1975 | Poupitch | |
| 3,932,569 A | | 1/1976 | Fuss | |
| 3,935,357 A | | 1/1976 | Padovani | |
| 4,007,538 A | | 2/1977 | Petrie | |
| 4,022,517 A | * | 5/1977 | Eckert | 312/317.1 |
| 4,112,810 A | | 9/1978 | Dreibelbis | |
| 4,195,732 A | * | 4/1980 | Bell | 206/391 |
| 4,261,940 A | | 4/1981 | Bussey, Jr. | |
| 4,349,109 A | | 9/1982 | Scordato et al. | |
| 4,501,355 A | | 2/1985 | Hoffman | |
| 4,566,831 A | | 1/1986 | Groth | |
| 4,643,310 A | | 2/1987 | Deaton et al. | |
| 4,850,256 A | | 7/1989 | Radi | |
| 4,921,101 A | | 5/1990 | Gatt | |
| 4,930,384 A | | 6/1990 | Nakatsuji | |
| 4,979,620 A | | 12/1990 | Delamare et al. | |
| 5,178,279 A | | 1/1993 | Carroll | |
| 5,267,652 A | | 12/1993 | Carroll | |
| 5,306,455 A | | 4/1994 | Carroll | |
| 5,339,958 A | * | 8/1994 | Taravella et al. | 206/521 |

FOREIGN PATENT DOCUMENTS

| | | |
|---|---|---|
| JP | 5548978 | 12/1980 |

* cited by examiner

*Primary Examiner*—John A. Ricci
(74) *Attorney, Agent, or Firm*—Brooks Kushman P.C.

(57) ABSTRACT

Dunnage for supporting elongated products arranged in layers in storage or shipping containers comprises elongated plastic strips having openings for receiving the goods and also having reinforcing members extending along their undersides which are removably received in dunnage supports attached to the sides of the container. The dunnage supports are so arranged that the reinforcing members are supported out of contact with subjacent and superjacent layers of the products and dunnage.

14 Claims, 3 Drawing Sheets

DUNNAGE

BACKGROUND OF THE INVENTION

1. Field of the Invention

This invention relates to dunnage and to a method for packaging layers of products in a container without the weight of superjacent products resting or bearing on subjacent products and wherein the products may be readily removed from the container until it is empty.

2. Background Art

In U.S. Pat. Nos. 5,267,652 and 5,178,279, incorporated herein by reference, dunnage is disclosed for supporting automotive parts or the like for shipment and storage pending use on an assembly line. It is intended that boxes containing the parts, which are supported in the dunnage, are placed adjacent the automotive assembly line, and as vehicles move down the line, the parts are removed from the boxes and placed in or on the vehicle. The dunnage may comprise elongated strips of polyethylene, polystyrene or the like having transverse slots or notches shaped to allow the parts to nestle therein so they do not rub against adjacent parts. This arrangement has been quite satisfactory.

In U.S. Pat. No. 5,267,652, the dunnage for one layer of products rests or bears on surfaces of the products of the subjacent layer, and when such surfaces are the Class A surfaces may result in marring the same. In such cases it is desirable to store the parts in layers in the boxes in such fashion that the superjacent dunnage is spaced from the Class A surfaces of the subjacent parts. On occasion this may be accomplished by designing the dunnage to have upstanding posts, such as shown in U.S. Pat. No. 5,178,279, where upstanding posts serve to hold superjacent dunnage out of contact with Class A surfaces of a subjacent layer.

In some instances the shape of the parts is such that the dunnage disclosed in the '652 patent or the '279 patent cannot be configured in themselves to avoid the dunnage of a superjacent layer from resting on or contacting the Class A surfaces of the parts in a subjacent layer or for any other reason the dunnage of such patents cannot hold the parts out of undesired contact either with other parts, or with the container in which the dunnage and parts are stored.

SUMMARY OF THE INVENTION

The elongated strips of dunnage shown in U.S. Pat. Nos. 5,267,652 or 5,178,279 have proven to be highly desirable for keeping layers of products in a shipping or storage container separated and avoid marring of class A surfaces. However, as mentioned above, the products may not lend themselves to having the weight of a superjacent layer of dunnage and product rest upon the subjacent layer of product or dunnage. In such instances, we have found that the dunnage may nevertheless be used if it is supported out of contact with the product or dunnage in a subjacent layer of dunnage. The dunnage shown in U.S. Pat. Nos. 5,267,652 or 5,178,279 is not in itself strong enough to prevent collapse if the dunnage is supported only at its ends. But, we have discovered that if each dunnage strip is supported from beneath and throughout its length by a reinforcing member with opposite ends of the reinforcing member received in pockets or the like on the walls of the shipping or storage container, the dunnage may be used with good results. Accordingly, we disclose a reinforcing member secured to the underside of the dunnage strips and supporting them throughout their length. Ends of the reinforcing member are removably disposed in pockets secured to or disposed within the walls of the box or other container within which the goods are housed. The reinforcing members are removably received in the pockets such that as the product is removed from the box, the dunnage may similarly be easily removed simply by lifting it out of the pockets thereby to gain access to a subjacent layer of product. In the disclosed form of the reinforcing member, it is formed of a corrugated plastic panel scored and folded upon itself in a triangular shape, and the pockets into which the ends of the reinforcing members are received are of a similar V-shape.

DETAILED DESCRIPTION OF THE PREFERRED EMBODIMENT(S)

Figure 1:
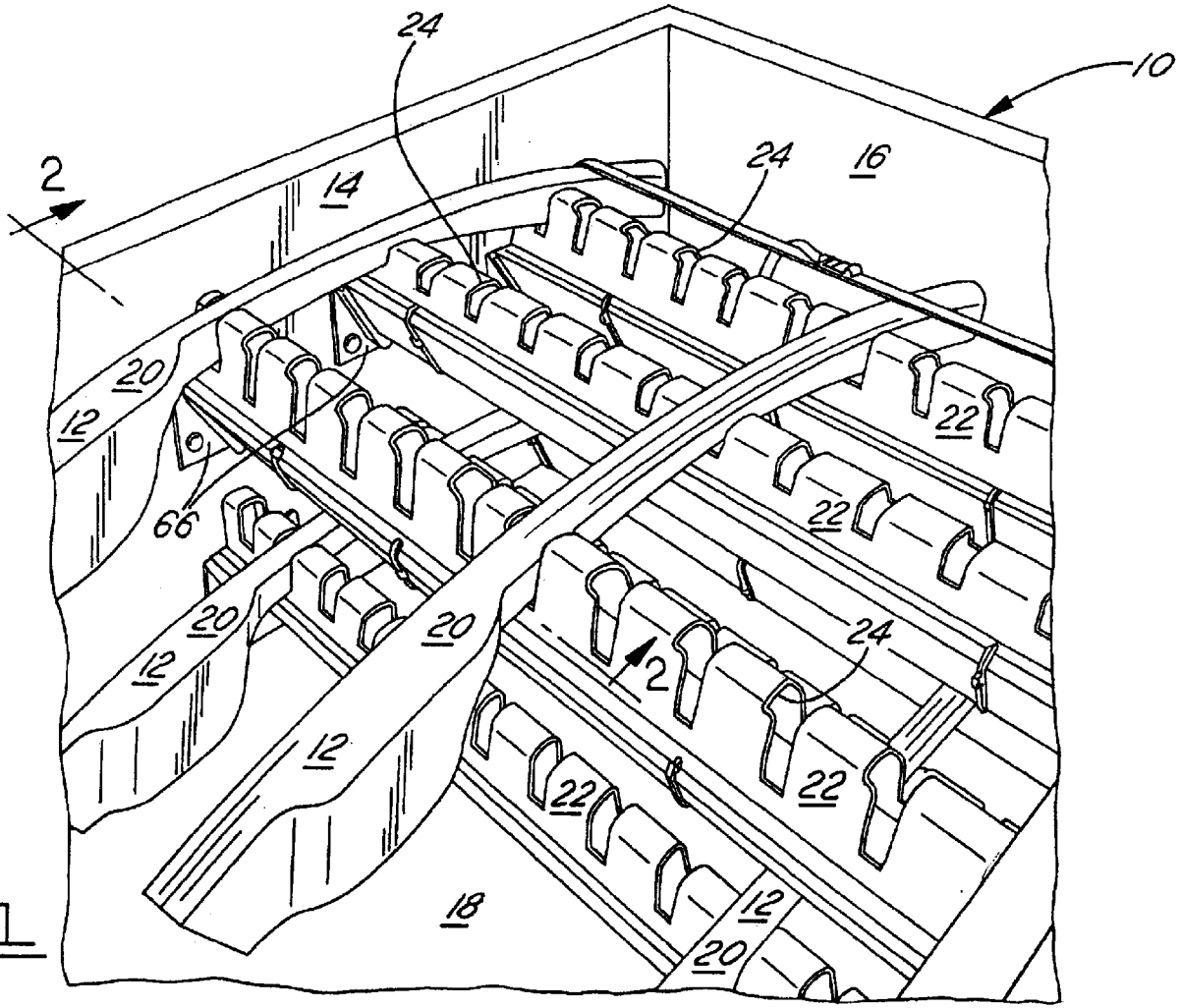
FIG. 1 is a fragmentary perspective of our improved dunnage in a shipping or storage container.

FIG. 1 is a fragmentary view of a corner of a shipping or storage container (sometimes referred to herein as a box) for elongated products, a few of which are depicted at 12. The shipping or storage container is of conventional construction having four side walls 14 and 16 and opposite parallel walls not shown. Conventionally, the shipping or storage container will have a bottom wall 18 and may be open at the top. The container may be formed of any suitable material such as cardboard, plastic, metal or the like, depending upon the nature of the products being shipped and the conditions of shipment. In the present case, it is intended that the shipping or storage container be of a box-like construction with the wall 16 and its opposite wall (not shown) being spaced apart at least the length of the product 12, and the dunnage supporting the product extending transversely of the product between the side wall 14 and its opposite wall (not shown). A principal use is in the automotive supply business in which shipping or storage containers are filled with products at an automotive supplier and then the container is shipped to the automotive assembly plant and placed adjacent the assembly line. As a vehicle on the line approaches the container, a workman may remove the products from the container and affix them to the vehicle. This is desirably accomplished by simply lifting the products vertically out of the box and placing them on or in the vehicle. When the top layer of products has been removed, it is desirable that the dunnage similarly be easily removed exposing the next subjacent layer of product for use.

The product contained within the box which is shown at 12 in FIG. 1 for purposes of illustration is assumed to have an upwardly facing Class A surface which must not be marred or disfigured during storage and shipment. Accordingly, superjacent layers of dunnage and product are not allowed to rest upon the Class A surfaces. Such surfaces are indicated by the reference numeral 20 in FIG. 1. The elongated products extend between the side wall 16 and its opposite wall (not shown) while the dunnage extends at substantially right angles to the product and extends between the wall 14 and its opposite wall (not shown).

The dunnage comprises an upwardly facing product receiving and supporting strip in the form of an extruded plastic tube 22 and a downwardly facing rigidifying portion 34 extending along beneath the tube to support the same against collapse and hold it out of contact with an underlying layer of the products. The extruded plastic tubes 22 are resilient and soft enough so that they do not mar other surfaces of the product, which may include Class A surfaces. The character of such tubing is disclosed in U.S. Pat. No. 5,267,652. Each tube has a series of cut-outs or openings 24 which are shaped and adapted to receive the products to be shipped or stored in the container. A cross-section of a typical tube is shown at 22 in FIG. 3. The tube has a crown portion 26, side walls 28 and 30 and a bottom wall 32. For more detail of the tubes, reference should be made to U.S. Pat. No. 5,267,652.

Figures 3, 4, 5:
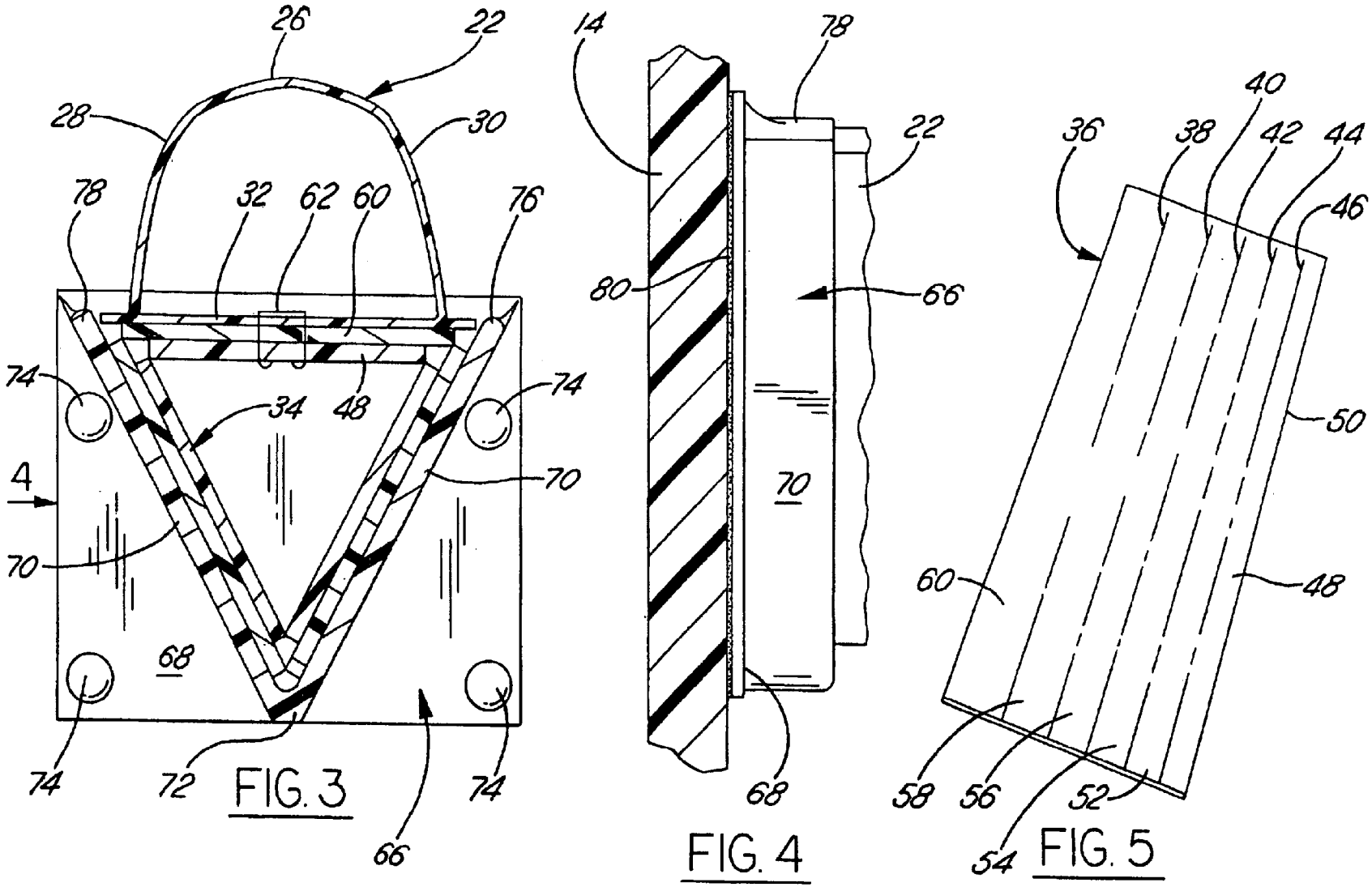
FIG. 3 is a cross-sectional view taken on line 3—3 of FIG. 2.
FIG. 4 is a side view of a dunnage support looking in the direction of arrow 4 of FIG. 3.
FIG. 5 is a plan view of the plastic corrugated panel prior to folding into the reinforcing member.

To support the dunnage and prevent collapse when loaded with the products to be shipped or stored, and to hold it spaced out of contact with superjacent or subjacent layers of the product, reinforcing members 34 extend along the length of the tubes and in supporting abutment with the bottom wall 32 thereof as best shown in FIG. 3. Each reinforcing member is preferably formed from a relatively rigid corrugated-like sheet or panel 36 scored and then folded into triangular configuration as shown in FIG. 5. The panel 36 is sold under the name COR-X by several companies including Primax Plastics Corporation of Richmond, Va. The material used in manufacturing the panel may be either polypropylene or polyethylene. The scoring is indicated at 38, 40, 42, 44 and 46. The scoring enables the plastic sheet or panel to be folded into the triangular configuration shown in FIG. 3. The narrowest panel 48 defined by the score line 46 and the edge 50 of the sheet is depicted in FIG. 3. Other panels defined by the scoring of the sheet are depicted at 52, 54, 56, 58 and 60 in FIG. 5, and some of such panels are referenced in FIG. 3. The load bearing capacity of the reinforcing members 34 may be increased or reduced by the number of score lines and consequent number of laminations in the reinforcing members.

To secure the reinforcing member to the tube and also prevent the reinforcing member from delaminating, staples 62, one of which is shown in FIG. 3, may be driven through the several laminations or panels and also through the bottom wall 32 of the tube. This will serve to prevent delamination of the reinforcing member and also hold the reinforcing member and tube together. Staples 62 may be spaced apart along the length of the tube and reinforcing member as desired.

Figure 2:
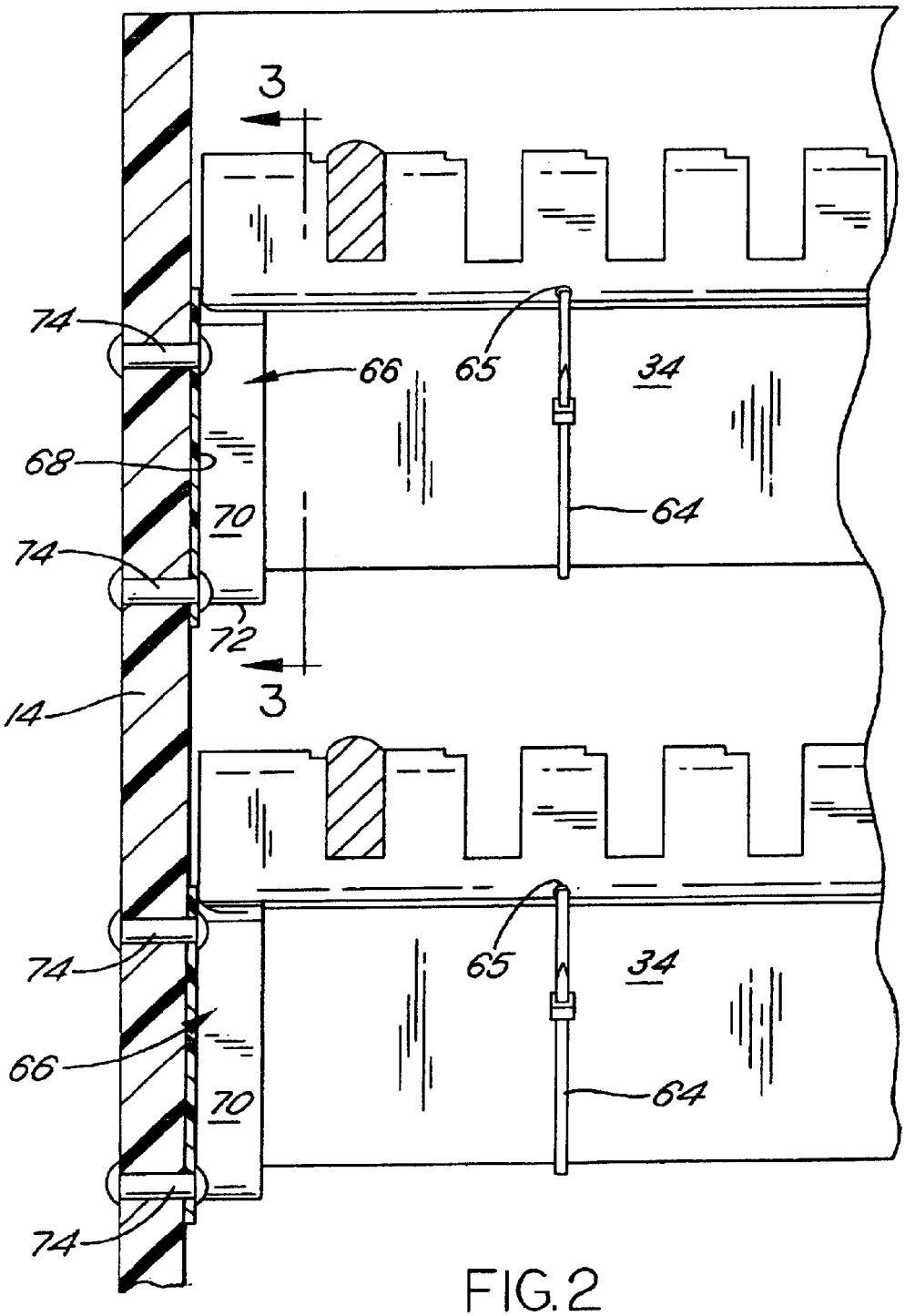
FIG. 2 is a cross-sectional view taken on line 2—2 in FIG. 1 showing two layers of dunnage and product.

In addition to, or in lieu of the staples 62, bag ties 64 may also be used to secure the reinforcing member to the tube and prevent delamination. In the case of bag ties, holes 65 would be provided in the tubes and the bag ties threaded therethrough and around the reinforcing members 34 as shown in FIG. 2. The laminations of the reinforcing member can also be held together by sonic welding.

The ends of the reinforcing members 34 are supported on the side wall 14 of the box 10, and its opposed companion wall not shown, by dunnage supports 66 which may be molded or vacuum-formed of any suitable plastic. Each of the supports comprises a base plate 68 with a V-shaped shoulder 70, the apex 72 of which extends downwardly with the shoulder forming a V-shaped pocket into which the end of the reinforcing member is received. This is best shown in FIGS. 2 and 3. The dunnage supports 66 may be secured to the side wall 14 of the box and the opposite companion wall (not shown) by rivets 74 as shown in FIG. 2. The dunnage supports open upwardly at the ends 76 and 78 of the V-shaped shoulder as best shown in FIG. 3, and the dunnage tubes and associated reinforcing members may be placed in and readily removed from the V-shaped pockets.

If desired, an adhesive layer 80 may be disposed between the wall 14 of the container and the plate 68 of the dunnage support as shown in FIG. 4.

While we have illustrated the invention in reference to the use of tubular dunnage 22, such as shown in U.S. Pat. No. 5,267,652, it will be understood that the cast or vacuum formed plastic strips illustrated in U.S. Pat. No. 5,178,279 may be similarly used with the reinforcing members 34 whereby the vacuum formed strips are supported throughout their length and ends of the reinforcing members are received in V-shaped or the like pockets in or at the side walls of the containers. Such strips may be secured to the reinforcing members 34 by the use of bag ties, stapling or any other suitable devices.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A shipping or storage container for elongated products arranged in layers comprising, in combination:

a box having four side walls with two of the walls being opposed and spaced apart at least the length of the products to be shipped or stored;

dunnage arranged in layers in the box extending lengthwise between the other two side walls for receiving and supporting the products in layers in the box;

said dunnage comprising elongated resilient plastic strips having product receiving openings within which the products are received for holding the products out of contact with adjacent products;

reinforcing members for the strips extending along the length thereof for preventing sagging thereof; and said other two side walls of the box having dunnage supports adjacent the ends of the reinforcing members for removably receiving and supporting said reinforcing members and associated strips out of contact with superjacent or subjacent layers of products.

2. The invention of claim 1 wherein the plastic strips are elongated tubes.

3. The invention of claim 1 wherein said dunnage supports comprise upwardly opening pockets for removably receiving the reinforcing members.

4. The invention of claim 3 wherein the reinforcing members extend along beneath the plastic strips and means are provided securing the reinforcing members thereto.

5. The invention of claim 4 wherein said means comprise bag ties.

6. The invention of claim 4 wherein said means comprise staples projecting through the reinforcing member and through the plastic strips.

7. The invention of claim 1 wherein each reinforcing member comprises a triangular tube underlying said plastic strips with an apex of the triangular shape extending downwardly therefrom.

8. The invention of claim 7 wherein the dunnage supports have upwardly opening V-shaped pockets for removably receiving the triangular tube.

9. Dunnage for supporting multiple layers of products in a box and wherein the weight of superjacent layers of products and dunnage is not borne by surfaces of subjacent layers of products comprising, in combination:

elongated dunnage for disposal in the box and of a length to bridge between opposite side walls of the box;

said dunnage having a plastic upwardly facing product receiving and supporting portion and a downwardly facing rigidifying plastic portion extending along beneath the product receiving portion; and, dunnage supports attached to side walls of the box at opposite ends of the dunnage and removably receiving the dunnage and supporting the same out of contact with superjacent or subjacent layers of the product.

10. The invention of claim 9 wherein said downwardly facing rigidifying portion comprises a reinforcing member of triangular cross-sectional shape disposed in juxtaposition beneath the upwardly facing product receiving and supporting portion and means securing the reinforcing member and product receiving portion together.

11. The invention of claim 10 wherein the reinforcing member comprises a plastic panel folded upon itself into a triangular configuration with means holding the folded panel sections together.

12. The invention of claim 11 wherein said means comprises bag ties wound around the folded plastic panel.

13. The invention of claim 11 wherein the bag ties are extended through the upwardly facing product receiving portion to secure the same to the reinforcing member.

14. A shipping or storage container for elongated products arranged in layers comprising, in combination:

a box having four walls;

dunnage arranged in the box and extending between two of the walls;

said dunnage including upper plastic strips having product receiving openings, and lower reinforcing strips secured to the upper plastic strips; and said two walls having supports for removably supporting the dunnage out of contact with adjacent upper or lower layers of product disposed in said product receiving openings.

* * * * *